United States Patent [19]

Steel

[11] Patent Number: 4,966,324

[45] Date of Patent: Oct. 30, 1990

[54] INTEGRAL CARRYING HANDLE FOR A CAN CARTON AND CARTON BLANK CONTAINING SAME

[76] Inventor: Thomas C. Steel, 45 Ogston Ter., Malverne, N.Y. 11565

[21] Appl. No.: 454,520

[22] Filed: Dec. 21, 1989

[51] Int. Cl.[5] ..... B65D 5/46

[52] U.S. Cl. ..... 229/117.13; 206/140; 206/427

[58] Field of Search ..... 229/117.13; 206/140, 206/427, 434

[56] References Cited

U.S. PATENT DOCUMENTS

| | | | |
|---|---|---|---|
| 2,785,847 | 3/1957 | Forrer | 229/117.13 |
| 3,593,849 | 7/1971 | Helms | 206/427 |
| 4,405,078 | 9/1983 | Dutcher et al. | 229/117.13 |
| 4,684,059 | 8/1987 | Rusnock | 229/117.13 |
| 4,728,025 | 3/1988 | Oliff | 206/427 |
| 4,728,026 | 3/1988 | Schuster | 229/117.13 |
| 4,784,316 | 11/1988 | Crouch | 229/117.13 |
| 4,785,991 | 11/1988 | Schuster | 229/117.13 |
| 4,811,894 | 3/1989 | Schuster | 229/117.13 |

*Primary Examiner*—Gary E. Elkins
*Attorney, Agent, or Firm*—Collard, Roe & Galgano

[57] ABSTRACT

A carrying handle for a carton for packaging a plurality of cans and having interconnected top, bottom and side walls, and end closure panels, includes a transverse slit extending completely across one of the interconnected carton walls. The transverse slit has end projections extending into the two walls interconnected with the one of the carton walls. A transverse fold line extends completely across the one of the interconnected carton walls and is spaced from and disposed generally parallel to the transverse slit. The fold line had end projections extending into the two walls interconnected with the one of the carton walls which terminate adjacent to the corresponding end projection of the transverse slit. As a result, the transverse fold line and the transverse slit cooperatively define therebetween a foldable transverse handle flap struck from the one of the interconnected carton walls and the two walls interconnected therewith, foldably joined thereto via the fold line. A carton blank for erecting a carton having this carrying handle is also disclosed.

32 Claims, 5 Drawing Sheets

INTEGRAL CARRYING HANDLE FOR A CAN CARTON AND CARTON BLANK CONTAINING SAME

BACKGROUND OF THE INVENTION

The present invention relates generally to can cartons. More particularly, it relates to integral carrying handles for such cartons and a carton blank containing the same.

Various types of carrying handles for can cartons are well known and in wide use (see, e.g., U.S. Pat. Nos. 3,894,681 and 4,364,509). These cartons, used for the packaging of articles, such as, canned beer, soft drinks and the like, are designed to accept a predetermined number of cans, for example, twelve, twenty-four, or thirty, arranged in a multiple row formation. These multiple can packs typically have an integral handle, formed in the carton, for lifting and carrying by the customer. U.S. Pat. No. 4,558,816, discloses a fold-under type integral carrying handle for a can carton. In this patent, a can carton has a carrying handle defined in part by a perforated transverse slit extending completely across one carton wall and having end projections disposed in substantially perpendicular relation to the one carton wall, which extend into the two carton walls interconnected therewith. Two perforated or slit transverse fold lines are disposed generally parallel to the transverse perforated slit, on opposite sides thereof, which together with the transverse slit define a pair of semi-oval configured handle flaps in the carton panel. The customer presses his fingers against one of the flaps causing it to swing inwardly and fold under the adjacent carton wall. The user then simply lifts the carton with his fingers curled underneath and gripping the folded-under handle.

While satisfactory in use, this construction does have several disadvantages. In particular, the handle flaps do not extend across the entire carton wall. As a result, it cannot easily accommodate large hands and it also creates stress points on the four corners, which can cause ripping of the carton when jerked and/or can pinch the user's hand. This handle construction is not particularly strong and, therefore, requires board stock of relatively greater thickness to insure carton integrity during handling.

SUMMARY OF THE INVENTION

Accordingly, it is an object of the present invention to provide an improved handle for a multi-can pack which greatly increases the lifting and carrying strength of the package.

It is also an object of the present invention to provide such a handle which the consumer can easily understand how to use and will find extremely comfortable when carrying the pack home from the market.

It is a further object of the present invention to provide such a handle and carton of increased strength to thereby reduce the chance of carton rupture and possible injury of the customer, as a result of being struck by falling cans.

It is also another object of the present invention to provide such a carton handle of a fold under design which minimizes the chance of the customer receiving accidental paper cuts.

It is yet another object of the present invention to provide such an improved handle which will require no equipment changes, operational changes, speed reduction or increase costs of any kind in carton production by the carton manufacturer.

It is a more particular object of the present invention to provide such a carrying handle, having the foregoing attributes and characteristics, which allows a significant reduction of board caliper on any size multi-pack without loss of handle strength or integrity and which also allows the use of recycled board.

Certain of the foregoing and related objects are readily obtained in a carrying handle for a carton for packaging a plurality of cans and having interconnected top, body and side walls and enclosure panels. The carrying handle includes a transverse slit extending completely across one of the interconnected carton walls and having end projections extending into the two walls interconnected with the "one" of the carton walls, and a transverse fold line extending completely across said one of the interconnected carton walls which is spaced from and disposed generally parallel to the transverse slit. The fold line has end projections extending into the two walls interconnected with said one of the carton walls which terminate adjacent to the corresponding end projection of the transverse slit. The transverse fold line and the transverse slit cooperatively define therebetween a foldable transverse handle flap struck from said one of the interconnected carton walls and the two walls interconnected therewith, foldably joined thereto via the fold line.

Preferably, the transverse handle flap has a main central portion which is foldable inwardly through an angle of approximately 180°, into face contacting relation with the inner surface of said one of the interconnected carton walls and two outer end portions which flex inwardly to substantially tangentially wrap the end of an adjacent can disposed within the carton when the handle flap is inwardly folded. Most desirably, an end slit is formed in each of the two walls interconnected with said one of the carton walls, which end slit intersects the associated transverse slit and fold line end projections and is disposed generally normally relative thereto.

In a preferred embodiment of the invention, a pair of auxiliary fold lines is formed in said one carton wall adjacent to opposite ends thereof which extend between the transverse slit and the transverse fold line at an angle thereto. The auxiliary fold lines facilitate the folding of the transverse handle flap.

It is particularly advantageous that the transverse fold line is an unperforated crease or score line. It is also desirable that the auxiliary fold lines comprise unperforated crease or score lines. Preferably, the transverse slit comprises a knife cut line.

In a particularly preferred embodiment, the handle includes a pair of the transverse fold lines, each of which is disposed on opposite sides of the transverse slit, so that the transverse fold lines and the transverse slit cooperatively define therebetween two foldable transverse handle flaps.

In one preferred embodiment of the invention, each of the end projections of the transverse slit intersect with the associated end projection of the fold line. In addition, the end projections of the transverse fold line extend collinearly with respect to the transverse fold line and each of the end projections of the transverse slit are angled to intersect the ends of the associated end projections of the transverse fold lines. Most desirably, the end projections of the transverse fold line extend collinearly with respect to the transverse fold line, and the end projections of the transverse slit are V-shaped and angled to intersect the ends of the associated end projections of the transverse fold lines. In a further preferred embodiment, the two interconnected walls have cut-outs formed therein disposed generally between and bounded in part by the V-shaped end projections of the transverse slit.

Certain of the foregoing and related objects are also attained in a can carton blank, which includes a plurality of interconnected walls, including top, bottom and side walls and end closure panels and an integral carrying handle of the aforementioned type.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as definition of the limits of the invention.

In the drawings, wherein similar reference characters denote similar elements throughout the several views.

DETAILED DESCRIPTION OF THE PREFERRED EMBODIMENTS

Figure 1:
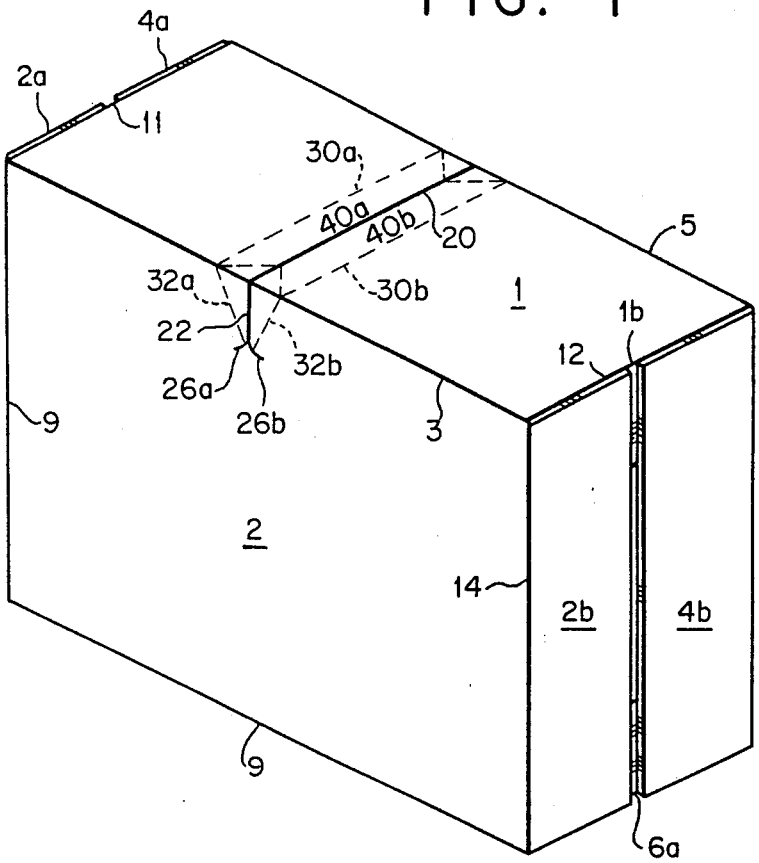
FIG. 1 is a perspective view of a loaded set-up can carton which embodies the handle construction of the present invention.
Figure 2:
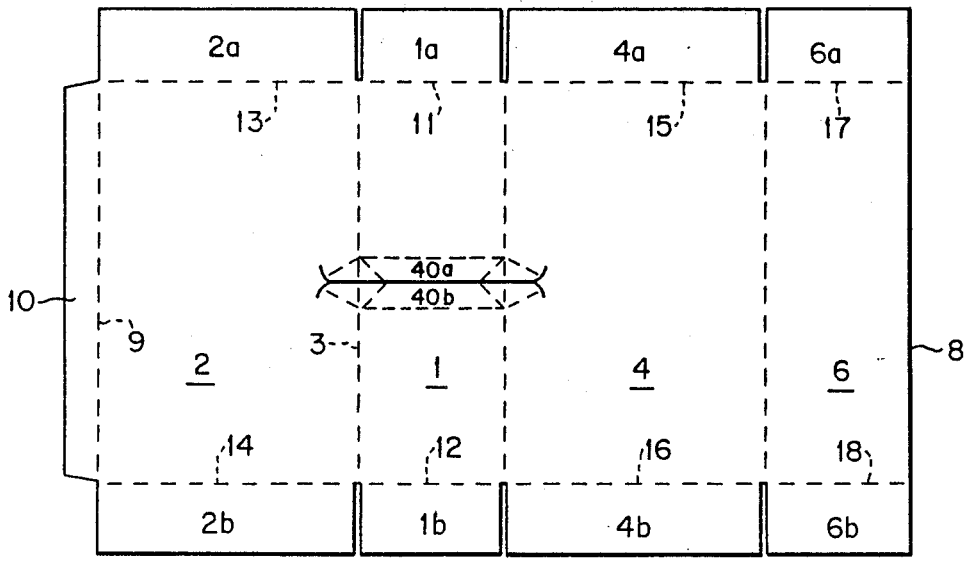
FIG. 2 is a plan view of a blank of foldable sheet material which is cut and scored to form the can carton shown in FIG. 1.

Turning now in detail to the drawings, and in particular to FIGS. 1 and 2, therein illustrated is a can carton embodying the present invention, which includes a top wall 1 to which a side wall 2 is foldably joined along fold line 3. A side wall 4 is disposed on the opposite side of top wall 1 and is connected thereto via fold line 5, as seen best in FIG. 2. Side wall 4 is in turn connected to bottom wall 6 via fold line 7. The opposite longitudinal edge 8 of bottom wall 6 is intended to abut and adjoin the fold line 9 of side wall 2, via a conventional glue flap 10 upon erection of the carton.

Each of the major panels 1, 2, 4 and 6 have associated end flaps or closure panels for forming the end panels of the multi-can carton. In particular, top wall 1 has opposite end flaps 1*a*, 1*b*, connected thereto via fold lines 11, 12, respectively. Side wall 2 has opposite end flaps 2*a*, 2*b*, connected thereto via fold lines 13, 14, respectively. Side wall 4 has opposite end flaps 4*a*, 4*b*, connected thereto via fold lines 15, 16, respectively. Bottom wall 6 has opposite end flaps 6*a*, 6*b*, connected thereto via fold lines 17, 18, respectively. End flaps 2*b*, 1*b*, 4*b* and 6*b* are secured with conventional adhesives in overlapping relation, as shown in FIG. 1. Although not illustrated, the same overlapping arrangement is also true for end flaps 2*a*, 1*a*, 4*a* and 6*a*.

Figure 3:
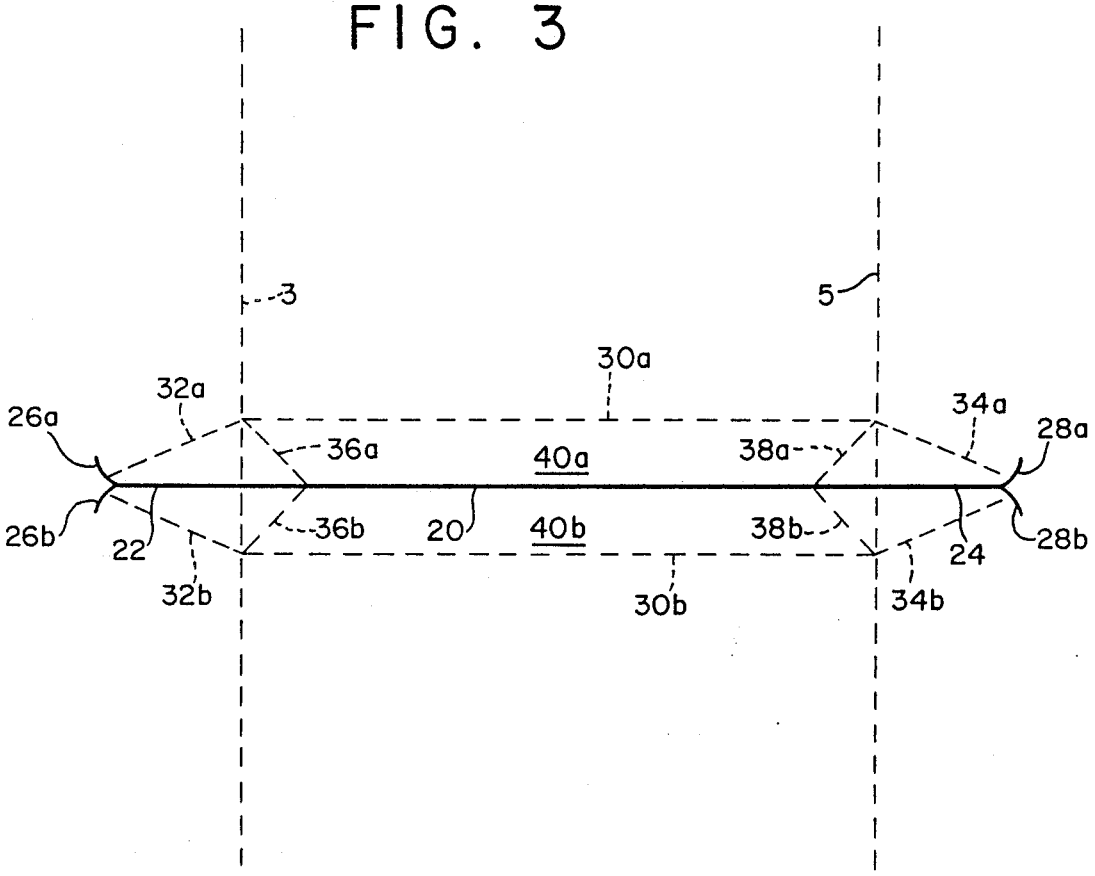
FIG. 3 is an enlarged, fragmentarily-illustrated portion of the blank shown in FIG. 2, showing the integral handle construction.

With reference to FIG. 3, a transverse slit or knife cut 20 is formed in top wall 1 and extends completely across that wall. In addition, this transverse slit 20 includes two end projections 22, 24 which extend downwardly into side wall 2 and into the opposite side wall 4, respectively. End projections 22, 24 each intersect end cuts 26*a*, 26*b* and 28*a*, 28*b*, respectively, which are disposed generally transverse to slit 20. End cuts 26*a*, 26*b* and 28*a*, 26*b* flare out in opposite directions from end projections 22, 24, respectively, and they serve to prevent slit extensions 22, 24 from propagating or ripping downwardly through sidewalls 34, causing rupture of the carton. Typically, end cuts are spaced below the top wall a distance equal to about ½ the diameter of the intended can (e.g., about 1¼ inches for a 2.5 inch diameter can).

A pair of transverse fold lines 30*a*, 30*b* are disposed on opposite sides of transverse slit 20, and are spaced generally parallel thereto. Each of the transverse fold line 30*a*, 30*b* have end projections 32*a*, 32*b*, and 34*a*, 34*b*, formed in the interconnected side wall panels 2 and 4, respectively, which taper to and terminate adjacent the end projections 22, 24 of transverse slit 20. A pair of supplemental fold lines 36*a*, 36*b* and 38*a*, 38*b* are formed in top panel 1, which assists in the folding-under operation of the handle, as described in greater detail hereinafter. Each of the fold lines 30*a* and 30*b*, together with their end projections 32*a*, 34*a* and 32*b*, 34*b*, define in cooperation with transverse slit 20 and its end projections 22, 24, a pair of handle flaps 40*a*, 40*b*, respectively.

Figure 4:
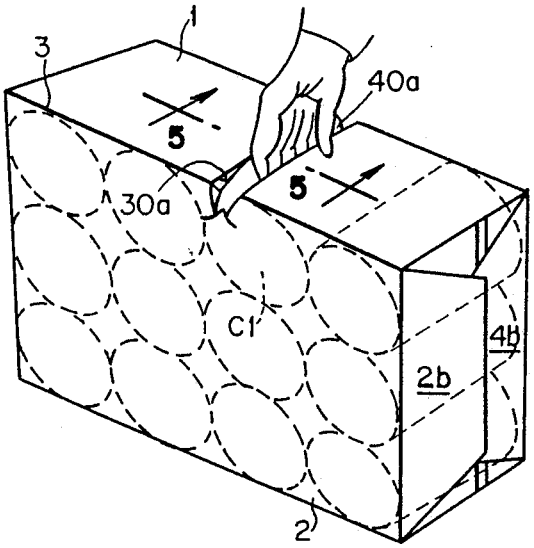
FIG. 4 is a perspective view similar to that of FIG. 1, but which further shows the carton in lifted condition and depicts the function of the handle flap and of parts associated therewith.
Figure 5:
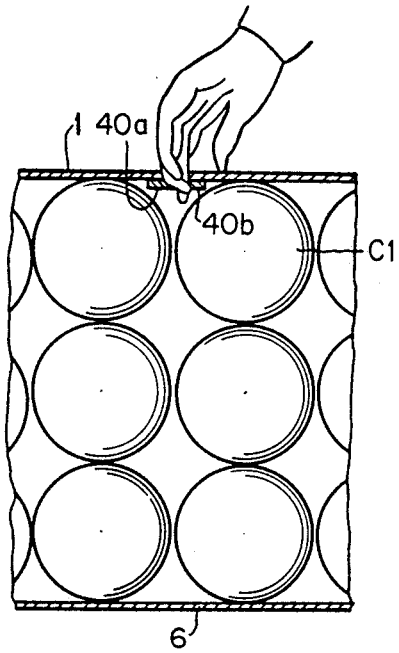
FIG. 5 is a fragmentarily illustrated, cross-sectional view taken along lines 5—5 of FIG. 4, also showing a user's hand depressing the handle into its folded-under condition.
Figure 6:
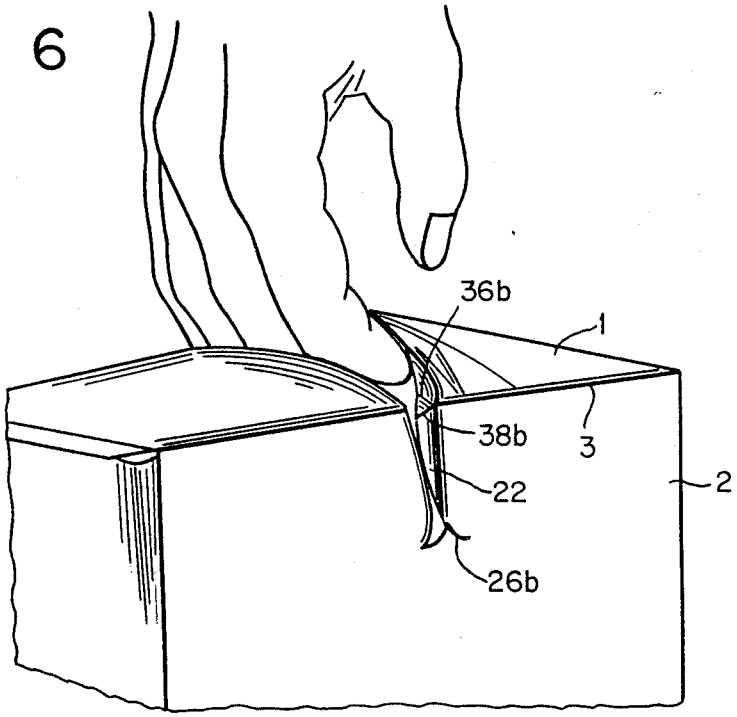
FIG. 6 is an enlarged, fragmentarily-illustrated, perspective view similar to that of FIG. 4, but at a reverse angle.

As shown best in FIGS. 4–6, in using the handle flap of this invention to lift and carry the carton, the fingers of the user are inserted against the flap, such as 40*b*. This operation causes the central portion of flap 40*b* to swing inwardly about its fold line 30*b* through an angle of approximately 180°, to occupy a position of flat-face contacting relation with the inner surface of a carton wall 1, as shown in FIG. 4. By this structure, flap 40*b* effectively reenforces top wall 1 and affords a cushion along fold line 30*b* which protects the hand of the user. This operation may be accompanied by a downward bending of flap 40*a*, so as to facilitate entry of the user's fingers into a position whereby folding of flap 40*b* may be effected.

Lifting of the carton causes inward bending of the triangular structure defined by slit ends projections 22, 24, fold line extensions 32*b*, 34*b* and fold lines 3 and 5, respectively, inwardly against the end of an associated can C1, as represented in FIGS. 5 and 6. The supplemental fold lines 36*b*, 38*b* assist the folding back of flap 40*b* in a neat and predetermined programmed manner as shown in FIG. 6. Preferably, the fold line extensions 32*b*, 34*b* are disposed approximately tangentially with respect to the end of the adjacent can C1. This folding operation results in a distribution of the load over a wide area of the carton side walls 2,4. In particular, the extensions of both the transverse slit 20 and the transverse fold lines 30*a*, 30*b* into the interconnected side walls 2,4, creates a longer handle which, in turn, shifts the stress points (which normally occur at the ends of the handle) to points relatively deep within the interior of the sidewalls 2,4, i.e., in the area adjacent the lower half of the fold extensions 32*b*, 34*b* (adjacent to the end cuts 26*b*, 28*b*). This "around the corner" web feature of the extended handle and the use of fold lines unbroken by knife cuts, slit scores or perforations provides vastly increased load carrying strength and serves to minimize rupture of the carton handle under heavy loads or as a result of jostling, etc. The "longer" handle also significantly increases the area for one to insert a hand under the handle flap, thereby allowing the user to grip the handle more firmly and also affording greater comfort and space for users with large hands.

The provision of two identical carrying flaps 40*a*, 40*b* and associated structure makes possible the lifting of the carton using either flap as a lifting element and frees the user from the necessity of determining precisely how to insert his fingers, i.e., a choice of flaps is provided.

The present handle design is believed to afford the strongest integral handle available for any paperboard multi-pack.

In particular, the above handle design provides a more efficient and even stronger carrying handle for a can carton as disclosed in U.S. Pat. No. 4,558,816 issued to Wood (assigned to The Mead Corporation). As a result, thinner paperboard stock can be used in constructing the carton. For example, whereas, the Mead handle typically requires 0.021 SUS (i.e., 21/1000" solid unbleached sulfate board) for a 12 can pack of 12 ounce beer containers, the present invention would allow one to use a 0.016 SUS board and, perhaps even thinner, since the present handle is at least ten times stronger. This twenty-five percent or greater reduction in board thickness also results in a savings of up to fifty percent in material cost. For a 24 can pack, 0.018 caliper board can be used according to the present invention, which is at least five times stronger than the current Mead handle used on a 24 can pack made from 0.027 SUS. The present handle is also stronger on any caliper board than tape reinforced sling style handle packs. Moreover, the present handle allows two 12 packs (0.016 SUS), taped together, to be lifted and carried as one unit without fear of handle failure.

This is accomplished without any change in the carton production equipment or the carton erecting machinery. Furthermore, no reduction of running speed on the press or gluing equipment is required. Also, no additional operations are required for carton production. The only additional cost is for minor changes in the present cutting and creasing dies. Moreover, although solid unbleached sulfate board (SUS) is normally used, the present invention allows recycled board to be employed. In addition, the extra strength afforded by the handles allows a variety of multiple packs to be employed, even with offset handles (i.e., they need not be centrally located).

FIGS. 7, 8 and FIGS. 9, 10 disclose two additional embodiments of the invention, which also offer improved strength and integrity over the construction of the Mead patented carton, although they don't afford the same strength as the main embodiment. The added strength is due to the fact that both embodiments also incorporate extensions of the transverse slit and fold lines to extend the handle arrangement into the side panels, thereby also distributing the load over the sidewalls 2, 4.

Figure 7:
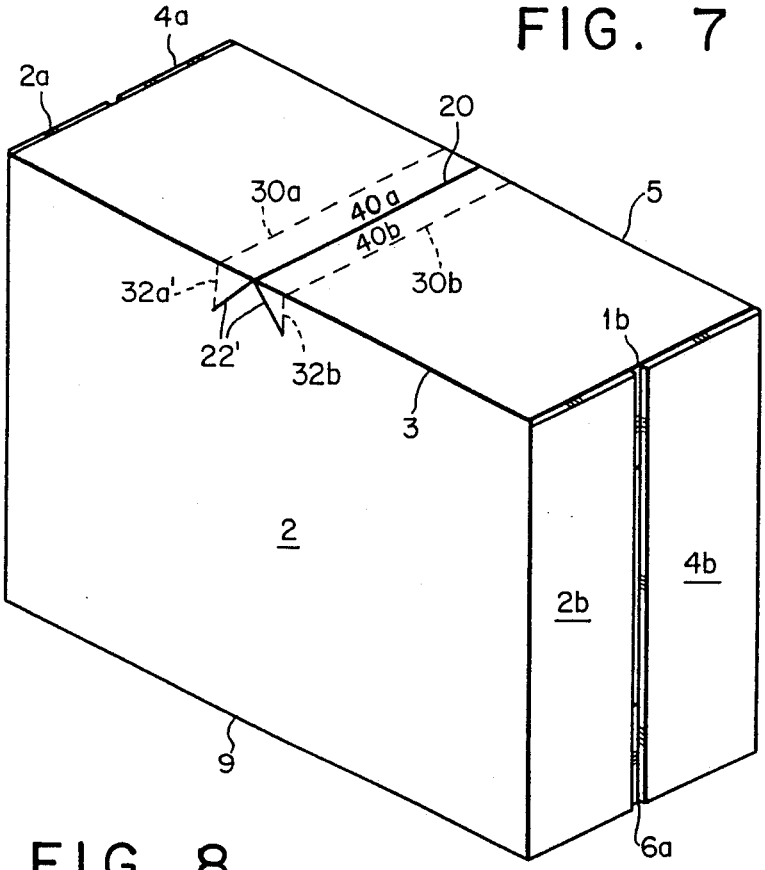
FIG. 7 is a perspective view of a loaded set-up can carton which includes a further embodiment of the handle structure of this invention.
Figure 8:
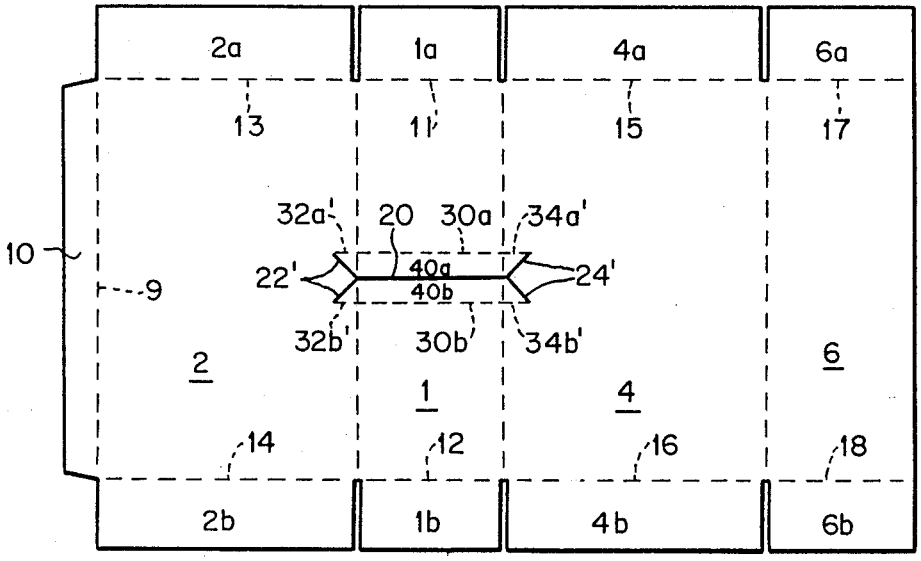
FIG. 8 is a plan view of a blank of foldable sheet material which is cut and scored to form the can carton shown in FIG. 7.
Figure 9:
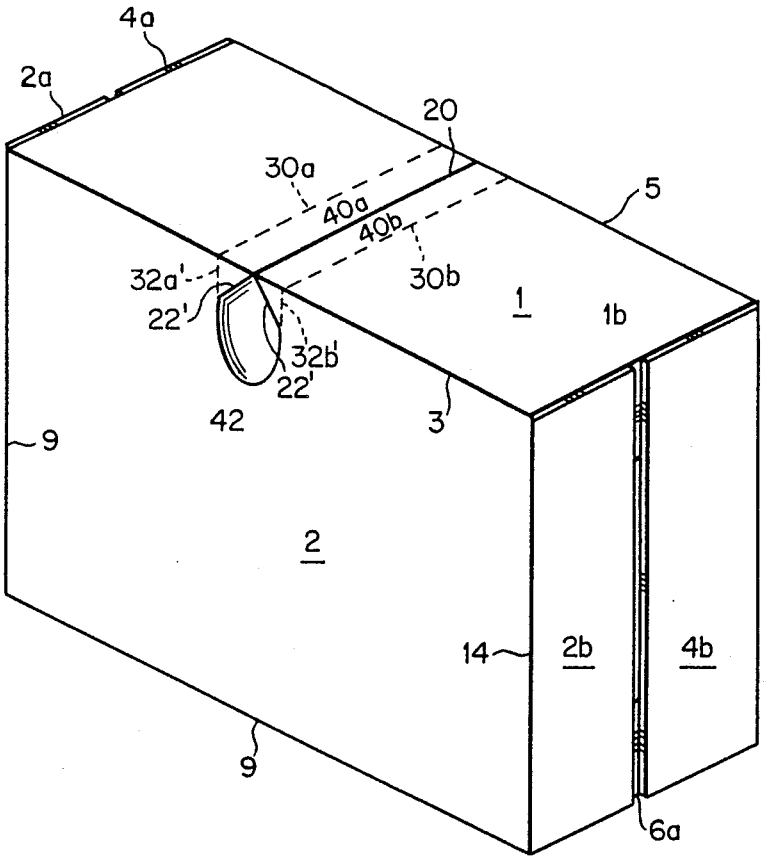
FIG. 9 is a perspective view of a loaded set-up can carton shown in which includes another embodiment of the handle structure of this invention.
Figure 10:
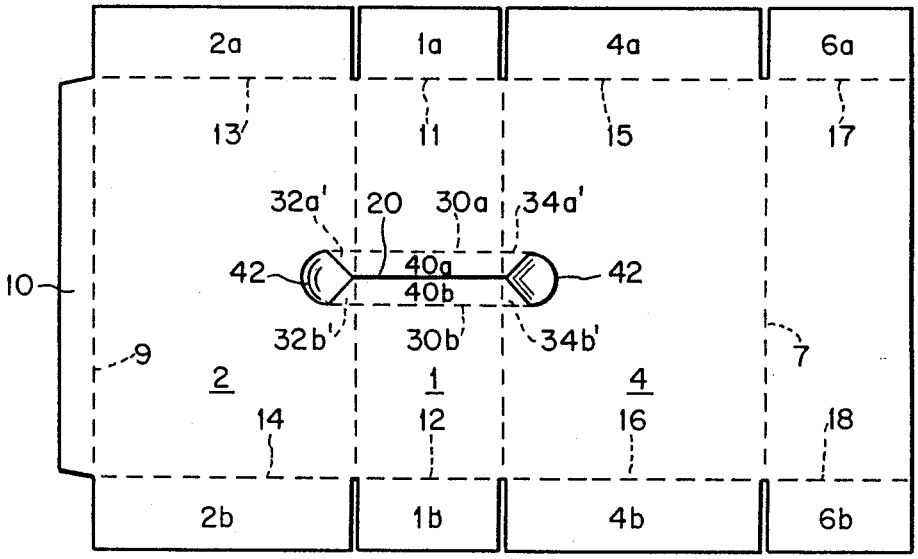
FIG. 10 is a plan view of a blank foldable sheet material which is cut and scored to form the can carton shown in FIG. 5.

More particularly, in the embodiment shown in FIGS. 7, 8, the carton construction and the handle construction are essentially the same, except for the following major points of distinction. Transverse slit 20 extends across the entire top panel 1 but its end extensions in side panels 2, 4, take the form of a V-shaped knife cuts 22', 24'. Transverse fold lines 30*a*, 30*b* also extend entirely across the main panel 1 as in the main embodiment but their end projections 32*a*', 34*a*', 32*b*', 34*b*' are collinear with fold lines 30*a*, 34*b* and they intersect the tips of the V-shaped end extensions 22', 24' of the transverse slit 20. The embodiments of FIGS. 9, 10 are the same as the embodiments of FIGS. 7, 8, except that the carton additionally includes cut-outs 42 in side panels 2 and 4, disposed between and bounded in part by said V-shaped end projections 22', 24'. The handle operation, however, for both these two embodiments is essentially the same as described in connection with FIGS. 1–6.

Various modifications may be made to the present invention, as will be apparent to those skilled in the art. For example, the dimensions and configurations of the paperboard cartons can, of course, be varied, depending on the particular intended end use and the size and number of the cans involved. In addition, although the end cuts are preferably arcuately shaped, they could be rectilinear or of other configurations, so long as they serve the purpose of preventing torque rupture or ripping of the transverse slit further into the side panels 2 and 4. Moreover, although the present handle design is specifically intended for paperboard cartons, it will also be suitable for any lightweight, flexible sheet material, such as, plastic or corrugated board. While the present invention is also primarily intended for use with beverage cans, it could be used for a wide variety of can types (i.e., food cans, oil cans, etc.).

Thus, while only several embodiments of the present invention have been shown and described, it is obvious that many changes and modifications may be made thereunto without departing from the spirit and scope of the invention.

What is claimed is:

1. A carrying handle or a carton for packaging a plurality of cans and having interconnected top, bottom and side walls, and end closure panels, said handle comprising:

a transverse slit extending completely across one of said interconnected carton walls and having end projections extending into the two walls interconnected with said one of said carton walls; and a transverse fold line extending completely across said one of said interconnected carton walls which is spaced from and disposed generally parallel to said transverse slit, said fold line having end projections extending into said two walls interconnected with said one of said carton walls which terminate adjacent to the corresponding end projection of said transverse slit, so that said transverse fold line and said transverse slit cooperatively define therebetween a foldable transverse handle flap struck from said one of said interconnected carton walls and said two walls interconnected therewith, foldably joined thereto via said fold line, said transverse handle flap having a main central portion which is foldable inwardly to an angle of approximately 180°, into face contacting relation with the inner surface of said one of said interconnected carton walls and two outer end portions which flex inwardly to substantially tangentially wrap the end of an adjacent can disposed within the carton when said associated handle flap is inwardly folded.

2. The carrying handle according to claim 1, additionally including an end slit formed in each of said two walls interconnected with said one of said carton walls, which end slit intersects the associated transverse slit and fold line end projections and is disposed generally normally relative thereto.

3. The carrying handle according to claim 1, additionally including a pair of auxiliary fold lines formed in said one carton wall adjacent to opposite ends thereof and extending between said transverse slit and said transverse fold line at an angle thereto, said auxiliary fold lines facilitating the folding of said transverse handle flap.

4. The carrying handle according to claim 1, wherein said transverse fold line is an unperforated crease line.

5. The carrying handle according to claim 3, wherein said auxiliary fold lines comprise unperforated crease lines.

6. The carrying handle according to claim 1, wherein said transverse slit comprises a knife cut line.

7. The carrying handle according to claim 1, wherein said handle includes a pair of said transverse fold lines, each of which is disposed on opposite sides of said transverse slit, so that said transverse fold lines and said transverse slit cooperatively define therebetween two foldable transverse handle flaps.

8. The carrying handle according to claim 1, wherein each of said end projections of said transverse slit intersect with the associated end projection of said fold line.

9. The carrying handle according to claim 8, wherein said end projections of said transverse fold line extend colinearly with respect to said transverse fold line and each of said end projections of said transverse slit are angled to intersect the end of the associated end projection of said transverse fold lines.

10. The carrying handle according to claim 8, wherein said end projections of said transverse fold line extend colinearly with respect to said transverse fold line, wherein said end projections of said transverse slit are V-shaped and angled to intersect the ends of the associated end projections of said transverse fold lines.

11. The carrying handle according to claim 10, wherein said two interconnected walls have cut-outs formed therein disposed generally between and bounded in part by said V-shaped end projections of said transverse slit.

12. A can carton blank, comprising:

a plurality of interconnected walls, including top, bottom and side walls and end closure panels;

a transverse slit extending completely across one of said interconnected carton walls and having end projections extending into the two walls interconnected with said one of said carton walls; and a transverse fold line extending completely across said one of said interconnected carton walls which is spaced from and disposed generally parallel to said transverse slit, said fold line having end projections extending into said two walls interconnected with said one of said carton walls which terminate adjacent to the corresponding end projection of said transverse slit, so that said transverse fold line and said transverse slit cooperatively define therebetween a foldable transverse handle flap struck from said one of said interconnected carton walls and said two walls interconnected therewith, foldably joined thereto via said fold line, said transverse handle flap having a main central portion which is foldable inwardly to an angle of approximately 180°, into face contacting relation with the inner surface of said one of said interconnected carton walls and two outer end portions which flex inwardly to substantially tangentially wrap the end of an adjacent can disposed within the carton when said associated handle flap is inwardly folded.

13. The can carton blank according to claim 12, additionally including an end slit formed in each of said two walls interconnected with said one of said carton walls, which end slit intersects the associated transverse slit and fold line end projections and is disposed generally normally relative thereto.

14. The can carton blank according to claim 12, additionally including a pair of auxiliary fold lines formed in said one carton wall adjacent to opposite ends thereof and extending between said transverse slit and said transverse fold line at an angle thereto, said auxiliary fold lines facilitating the folding of said transverse handle flap.

15. The can carton blank according to claim 12, wherein said transverse fold line is an unperforated crease line.

16. The can carton blank according to claim 12, wherein said auxiliary fold lines comprise unperforated crease lines.

17. The can carton blank according to claim 12, wherein said transverse slit comprises a knife cut line.

18. The can carton blank according to claim 12, wherein said handle includes a pair of said transverse fold lines, each of which is disposed on opposite sides of said transverse slit, so that said transverse fold lines and said transverse slit cooperatively define therebetween two foldable transverse handle flaps.

19. The can carton blank according to claim 12, wherein each of said end projections of said transverse slit intersect with the associated end projection of said fold line.

20. The can carton blank according to claim 12, wherein said end projections of said transverse fold line extend colinearly with respect to said transverse fold line and each of said end projections of said transverse slit are angled to intersect the end of the associated end projection of said transverse fold lines.

21. The can carton blank according to claim 12, wherein said end projections of said transverse fold line extend colinearly with respect to said transverse fold line, wherein said end projections of said transverse slit are V-shaped and angled to intersect the ends of the associated end projections of said transverse fold lines.

22. The can carton blank according to claim 12, wherein said two interconnected walls have cut-outs formed therein disposed generally between and bounded in part by said V-shaped end projections of said transverse slit.

23. A can carton blank, comprising:

a plurality of interconnected walls, including top, bottom and side walls and end closure panels;

a transverse slit extending completely across one of said interconnected carton walls and having end projections extending into the two walls interconnected with said one of said carton walls; and a pair of transverse fold lines extending completely across said one of said interconnected carton walls which are spaced from and disposed generally parallel to and on opposite sides of, said transverse slit, said fold lines each having end projections extending into said two walls interconnected with said one of said carton walls which terminate adjacent to the corresponding end projection of said transverse slit, so that said transverse fold lines and said transverse slit cooperatively define therebetween two foldable transverse handle flaps struck from said one of said interconnected carton walls and said two walls interconnected therewith, foldably joined thereto via said fold line, wherein each of said end projections of said transverse slit intersect with the associated end projection of said fold lines, said end projections of said transverse fold lines extending colinearly with respect to said transverse fold lines, and wherein said end projections of said transverse slit are V-shaped and angled to intersect the ends of the associated end projections of said transverse fold lines.

24. The can carton blank according to claim 23, wherein said transverse fold line is an unperforated crease line.

25. The can carton blank according to claim 23, wherein said transverse slit comprises a knife cut line.

26. The can carton blank according to claim 23, wherein said two interconnected walls have cut-outs formed therein disposed generally between and bounded in part by said V-shaped end projections of said transverse slit.

27. The can carton blank according to claim 23, wherein said transverse handle flaps each has a main central portion which is foldable inwardly to an angle of approximately 180°, into face contacting relation with the inner surface of said one of said interconnected carton walls and two outer end portions which flex inwardly to substantially tangentially wrap the end of an adjacent can disposed within the carton when said associated handle flap is inwardly folded.

28. A carrying handle for a carton for packaging a plurality of cans and having interconnected top, bottom and side walls, and end closure panels, said handle comprising:

a transverse slit extending completely across one of said interconnected carton walls and having end projections extending into the two walls interconnected with said one of said carton walls; and a pair of transverse fold lines extending completely across said one of said interconnected carton walls which are spaced from and disposed generally parallel to, and on opposite sides of, said transverse slit, said fold lines each having end projections extending into said two walls interconnected with said one of said carton walls which terminate adjacent to the corresponding end projection of said transverse slit, so that said transverse fold lines and said transverse slit cooperatively define therebetween two foldable transverse handle flaps struck from said one of said interconnected carton walls and said two walls interconnected therewith, foldably joined thereto via said fold lines, wherein each of said end projections of said transverse slit intersect with the associated end projection of said fold lines, said end projections of said transverse fold lines extending colinearly with respect to said transverse fold lines, and wherein said end projections of said transverse slit are V-shaped and angled to intersect the ends of the associated end projections of said transverse fold lines.

29. The carrying handle according to claim 28, wherein said transverse handle flaps each has a main central portion which is foldable inwardly to an angle of approximately 180°, into face contacting relation with the inner surface of said one of said interconnected carton walls and two outer end portions which flex inwardly to substantially tangentially wrap the end of an adjacent can disposed within the carton when said associated handle flap is inwardly folded.

30. The carrying handle according to claim 28, wherein said transverse fold line is an unperforated crease line.

31. The carrying handle according to claim 28, wherein said transverse slit comprises a knife cut line.

32. The carrying handle according to claim 28, wherein said two interconnected walls have cut-outs formed therein disposed generally between and bounded in part by said V-shaped end projections of said transverse slit.

* * * * *

US004966324B1

REEXAMINATION CERTIFICATE (2025th)

United States Patent [19]

Steel

[11] B1 4,966,324

[45] Certificate Issued May 25, 1993

[54] INTEGRAL CARRYING HANDLE FOR A CAN CARTON AND CARTON BLANK CONTAINING SAME

[76] Inventor: Thomas C. Steel, 45 Ogston Ter., Malverne, N.Y. 11565

Reexamination Request:
No. 90/002,381, Jun. 28, 1991

Reexamination Certificate for:

| | |
|---|---|
| Patent No.: | **4,966,324** |
| Issued: | **Oct. 30, 1990** |
| Appl. No.: | **454,520** |
| Filed: | **Dec. 21, 1989** |

[51] Int. Cl.[5] ..... B65D 5/46
[52] U.S. Cl. ..... 229/117.13; 206/140; 206/427
[58] Field of Search ..... 229/117.13, DIG. 4, 229/920

[56] References Cited

U.S. PATENT DOCUMENTS

| | | | |
|---|---|---|---|
| Re. 33,110 | 11/1989 | Wood et al. | 229/117.13 |
| 416,115 | 11/1889 | Mayall | 229/DIG. 4 |
| 1,705,748 | 3/1929 | Bridgman | 229/DIG. 4 |
| 1,789,105 | 1/1931 | Lange | 229/DIG. 4 |
| 2,785,847 | 3/1957 | Forrer | 229/117.13 |
| 3,593,849 | 7/1971 | Helms | 206/427 |
| 4,405,078 | 9/1983 | Dutcher et al. | 229/117.13 |
| 4,684,059 | 8/1987 | Rusnock | 229/117.13 |
| 4,728,025 | 3/1988 | Oliff | 206/427 |
| 4,728,026 | 3/1988 | Schuster | 229/117.13 |
| 4,784,316 | 11/1988 | Crouch | 229/117.13 |
| 4,785,991 | 11/1988 | Schuster | 229/117.13 |
| 4,811,894 | 3/1989 | Schuster | 229/117.13 |

FOREIGN PATENT DOCUMENTS 1602857 11/1981 United Kingdom .

*Primary Examiner*—Gary E. Elkins

[57] ABSTRACT

A carrying handle for a carton for packaging a plurality of cans and having interconnected top, bottom and side walls, and end closure panels, includes a transverse slit extending completely across one of the interconnected carton walls. The transverse slit has end projections extending into the two walls interconnected with the one of the carton walls. A transverse fold line extends completely across the one of the interconnected carton walls and is spaced from and disposed generally parallel to the transverse slit. The fold line had end projections extending into the two walls interconnected with the one of the carton walls which terminate adjacent to the corresponding end projection of the transverse slit. As a result, the transverse fold line and the transverse slit cooperatively define therebetween a foldable transverse handle flap struck from the one of the interconnected carton walls and the two walls interconnected therewith, foldably jointed thereto via the fold line. A carton blank for erecting a carton having this carrying handle is also disclosed.

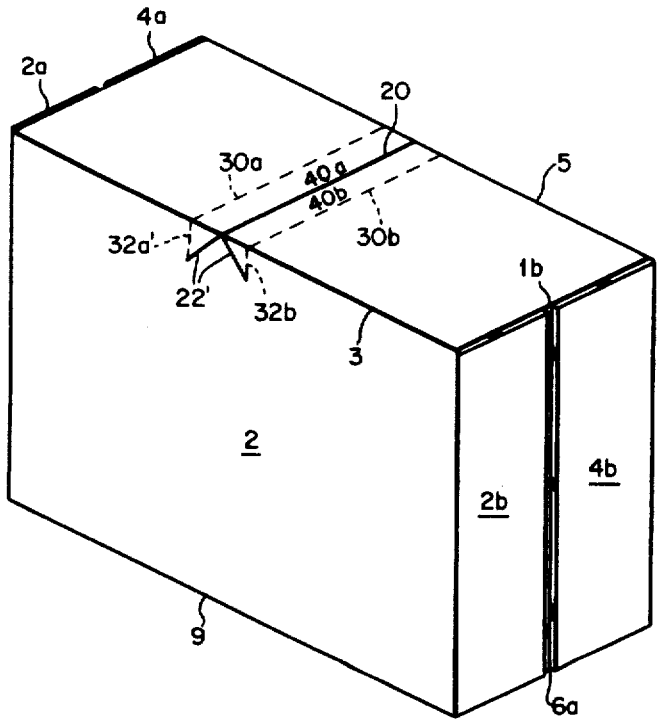

REEXAMINATION CERTIFICATE ISSUED UNDER 35 U.S.C. 307

THE PATENT IS HEREBY AMENDED AS INDICATED BELOW.

Matter enclosed in heave brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 23-32 is confirmed.

Claims 2, 9, 13, 20 are cancelled.

Claims 1, 10, 12, 16, 21, 22 are determined to be patentable as amended.

Claims 3-8, 11, 14, 15, 17-19, dependent on an amended claim, are determined to be patentable.

New claims 33 and 34 are added and determined to be patentable.

1. A carrying handle [or] *for* a carton for packaging a plurality of cans and having interconnected top, bottom and side walls, and end closure panels, said handle comprising:

a *rectilinear* transverse slit extending completely across one of said interconnected carton walls and having *collinear* end projections extending into the two walls interconnected with said one of said carton walls, *said transverse slit and end projections being oriented and positioned such that they will be substantially centered between two adjacent cans disposed within the carton and disposed closest thereto*; [and]

a *rectilinear* transverse fold line extending completely across one of said interconnected carton walls which is spaced from and disposed [generally] parallel to said transverse slit, said fold line having end projections extending into said two walls interconnected with said one of said carton walls which terminate adjacent to the corresponding end projection of said transverse slit, [so that] *said transverse fold line end projections being disposed such that they will be oriented approximately tangentially with respect to one of said closest adjacent cans disposed within the carton,* said transverse fold line and said transverse slit cooperatively define therebetween a foldable transverse handle flap struck from said one of said interconnected carton walls and said two walls interconnected therewith, foldably joined thereto via said fold line, said transverse handle flap having a main central portion which is foldable inwardly to an angle of approximately 180°, into face contacting relation with the inner surface of said one of said interconnected carton walls and two outer end portions which flex inwardly to substantially tangentially wrap the end of [an] *said* adjacent can disposed within the carton when said associated handle flap is inwardly folded[.] *; and*

*an end slit formed in each of said two walls interconnected with said one of said carton walls, which end slit intersects an associated one of the transverse slit end projections and fold line end projections and is disposed generally normally relative thereto.*

10. The carrying handle according to claim [8] *33*, wherein each of said end projections of said transverse slit intersect with the associated end projections of said fold line, wherein said end projections of said transverse fold line extend colinearly with respect to said transverse fold line, wherein said end projections of said transverse slit are V-shaped and angled to intersect the ends of the associated end projections of said transverse fold lines.

12. A can carton blank, comprising:

a plurality of interconnected walls, including top, bottom and side walls and end closure panels;

a *rectilinear* transverse slit extending completely across one of said interconnected carton walls and having *collinear* end projections extending into the two walls interconnected with said one of said carton walls, *said transverse slit and end projections being oriented and positioned such that they will be substantially centered between two adjacent cans disposed within the carton and disposed closest thereto*; [and ]

a *rectilinear* transverse fold line extending completely across said one of said interconnected carton walls which is spaced from and disposed [generally] parallel to said transverse slit, said fold line having end projections extending into said two walls interconnected with said one of said carton walls which terminate adjacent to the corresponding end projection of said transverse slit, [so that] *said transverse fold line end projections being disposed such that they will be oriented approximately tangentially with respect to one of said closest adjacent cans disposed within the carton,* said transverse fold line and said transverse slit cooperatively define therebetween a foldable transverse handle flap struck from said one of said interconnected carton walls and said two walls interconnected therewith, foldably joined thereto via said fold line, said transverse handle flap having a main central portion which is foldable inwardly to an angle of approximately 180°, into face contacting relation with the inner surface of said one of saidinterconnected carton walls and two outer end portions which flex inwardly to substantially tangentially wrap the end of [an] said one of said interconnected carton walls and said associated handle flap is inwardly folded[.] *; and*

*an end slit formed in each of said two walls interconnected with said one of said carton walls, which end slit intersects an associated one of the transverse slit end projections and fold line end projections and is disposed generally normally relative thereto.*

16. The can carton blank according to claim [12] *14*, wherein said auxiliary fold lines comprise unperforated crease lines.

21. The can carton blank according to claim [12] *34*, wherein said end projections of said transverse fold line extend colinearly with respect to said transverse fold line, wherein said end projections of said transverse slit are V-shaped and angled to intersect the ends of the associated end projections of said transverse fold lines.

22. The can carton blank according to claim [12] *21*, wherein said two interconnected walls have cutouts formed therein disposed generally between and bounded in part by said V-shaped end projections of said transverse slit.

*33. A carrying handle for a carton for packaging a plurality of cans and having interconnected top, bottom and side walls, and end closure panels, said handle comprising:*

*a transverse slit extending completely across one of said interconnected carton walls and having end projections extending into the two walls interconnected with said one of said carton walls;*

*a transverse fold line extending completely across said one of said interconnected carton walls which is spaced from and disposed generally parallel to said transverse slit, said fold line having end projections extending into said two wallsinterconnected with said one of said carton walls which terminate adjacent to the corresponding end projection of said transverse slit, so that said transverse fold line and said transverse slit cooperatively define therebetween a foldable transverse handle flap struck from said one of said interconnected carton walls and said two walls interconnected therewith, foldably joined thereto via said fold line, said transverse handle flap having a main central portion which is foldable inwardly to an angle of approximately 180°, into face contacting relation with the inner surface of said one of said interconnected carton walls and two outer end portions which flex inwardly to substantially tangentially wrap the end of an adjacent can disposed within the carton when said associated handle flap is inwardly folded; and*

*a pair of auxiliary fold lines formed in said one carton wall adjacent to opposite ends thereof and extending between said transverse slit and said transverse fold line at an angle thereto, said auxiliary fold lines facilitating the folding of said transverse handle flap.*

*34. A can carton blank, comprising:*

*a plurality of interconnected walls, including top, bottom and side walls and end closure panels;*

*a transverse slit extending completely across one of said interconnected carton walls and having end projections extending into the two walls interconnected with said one of said carton walls;*

*a transverse fold line extending completely across said one of said interconnected carton walls which is spaced from and disposed generally parallel to said transverse slit, saidfold line having end projections extending into said two walls interconnected with said one of said carton walls which terminate adjacent to the corresponding end projection of said transverse slit, so that said transverse fold line and said transverse slit cooperatively define therebetween a foldable transverse handle flap struck from said one of said interconnected carton walls and said two walls interconnected therewith, foldably joined thereto via said fold line, said transverse handle flap having a main central portion which is foldable inwardly to an angle of approximately 180°, into face contacting relation with the inner surface of said one of said interconnected carton walls and two outer end portions which flex inwardly to substantially tangentially wrap the end of an adjacent can disposed within the carton when said associated handle flap is inwardly folded; and*

*a pair of auxiliary fold lines formed in said one carton wall adjacent to opposite ends thereof and extending between said transverse slit and said transverse fold line at an angle thereto, said auxiliary fold lines facilitating the folding of said transverse handle flap.*

* * * * *